United States Patent [19]

Owen

[11] Patent Number: 4,795,354

[45] Date of Patent: Jan. 3, 1989

[54] DUST COVER FOR PRINTED CIRCUIT BOARD CARD CONNECTOR

[75] Inventor: Alex F. Owen, Spring Creek, Pa.

[73] Assignee: GTE Products Corporation, Stamford, Conn.

[21] Appl. No.: 91,417

[22] Filed: Sep. 3, 1987

[51] Int. Cl.[4] ..... H01R 13/44

[52] U.S. Cl. ..... 439/137; 439/271; 439/630; 439/59; 439/135

[58] Field of Search ..... 439/135, 137, 140–147, 439/271, 592, 892, 59, 76, 630, 519, 521

[56] References Cited

U.S. PATENT DOCUMENTS

| | | | |
|---|---|---|---|
| 4,109,989 | 8/1978 | Snyder, Jr. et al. | 439/140 |
| 4,197,945 | 4/1980 | Sherwood | 439/892 |
| 4,553,803 | 11/1985 | Lapraik et al. | 439/630 |
| 4,695,108 | 9/1987 | Ichitsubo | 439/59 |
| 4,705,338 | 11/1987 | Sitzler | 439/630 |

FOREIGN PATENT DOCUMENTS

| | | | |
|---|---|---|---|
| 1184250 | 3/1970 | United Kingdom | 439/135 |

*Primary Examiner*—Gil Weidenfeld
*Assistant Examiner*—P. Austin Bradley
*Attorney, Agent, or Firm*—William H. McNeill

[57] ABSTRACT

A dust cover for a ZF connector utilizes a three part, layered gasket for both wiping an inserted board and sealing the connector when the board is withdrawn. A first layer is a flexible, woven material, a second layer is a flexible, non-woven material, e.g., rubber, and the third layer is a rigid material including a slot to accommodate an inserted board as well as displaced material from the first two layers.

5 Claims, 3 Drawing Sheets

DUST COVER FOR PRINTED CIRCUIT BOARD CARD CONNECTOR

TECHNICAL FIELD

This information relates to printed circuit board card connector and more particularly to dust covers therefor. It has particular application to such covers for use with a class of connectors known as zero insertion force (ZIF) connectors.

BACKGROUND ART

The ZIF connector for printed circuit board cards has achieved a high degree of use in some fields. Its primary advantage derives from its included means to open up its electrical contacts whereby a printed circuit card can be inserted without the application of a force great enough to overcome the frictional resistance of electrical contacts which are not so opened. Such connectors are shown, for example, in U.S. Pat. No. 4,553,803. It is, perhaps, ironic that the main advantage of such connectors also provides a disadvantage; namely, some wiping action is occasionally desired to remove dust and oxidization from the contacts on the card connector, and the ZIF connectors generally do not provide this action in an amount sufficient to be useful. (It is noted that connectors of the type referenced above provide some wiping action).

On the other hand, dust, generally, is always a problem in any electronic environment where electrostatic forces provide an attractant.

DISCLOSURE OF THE INVENTION

It is, therefore, an object of this invention to obviate the disadvantages of the prior art.

It is another object of the invention to enhance card connectors.

Yet another object of the invention is the provision of a dust cover for a card connector which dust cover also provides a wiping action.

The objects are accomplished, in one aspect of the invention, by the provision of a dust cover which comprises an elongated body formed to fit over a card connector and be secured thereto. The cover has a top surface which includes a card receiving slot. The interior side of the top surface includes a sealing gasket formed from a flexible material and having a longitudinal slit therein. The slit is aligned with the center of the slot. Because of its flexibility, the sealing gasket slit normally remains closed when the connector with which it is associated is not in use, thus keeping the connector environment dust free; however, it will yield to receive a card connector, while simultaneously wiping it to clean its electrical contacts.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
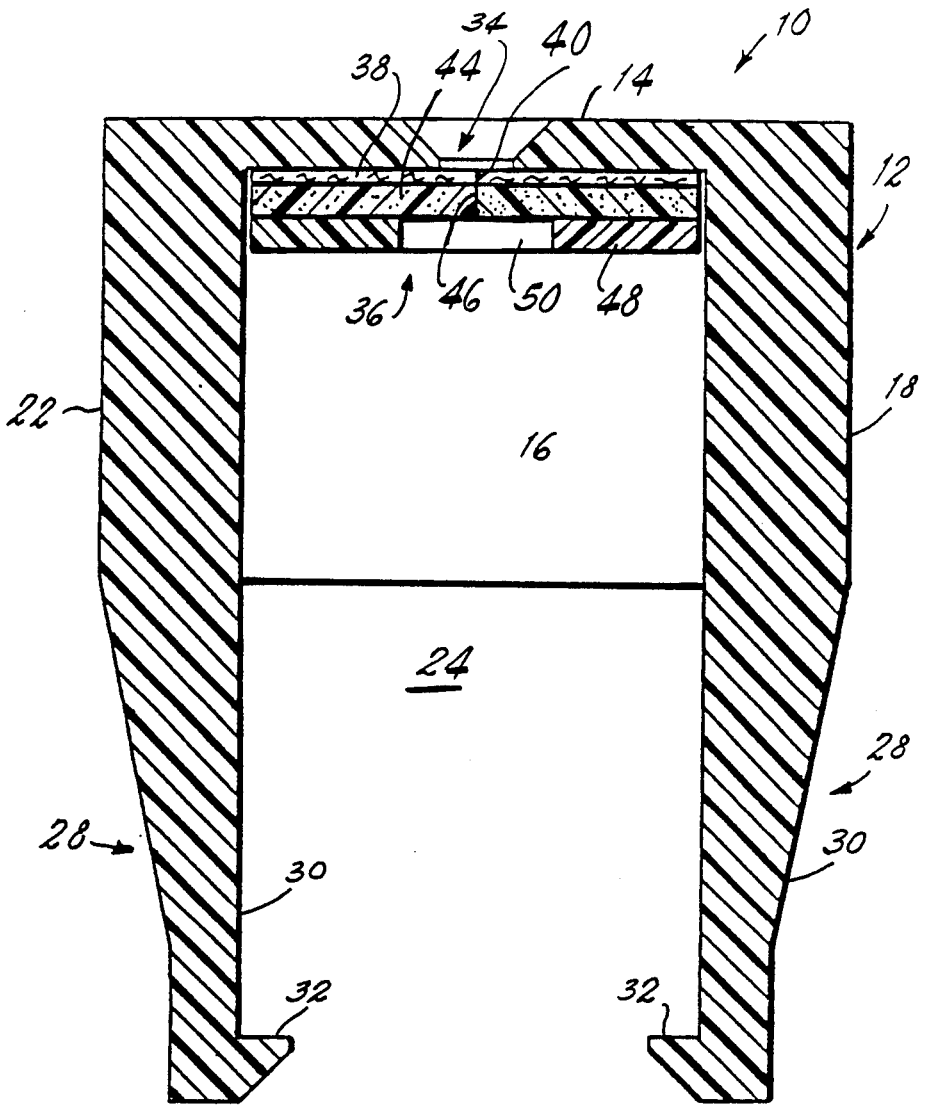
FIG. 1 is a sectional, elevational view of an embodiment of the invention.
Figure 2:
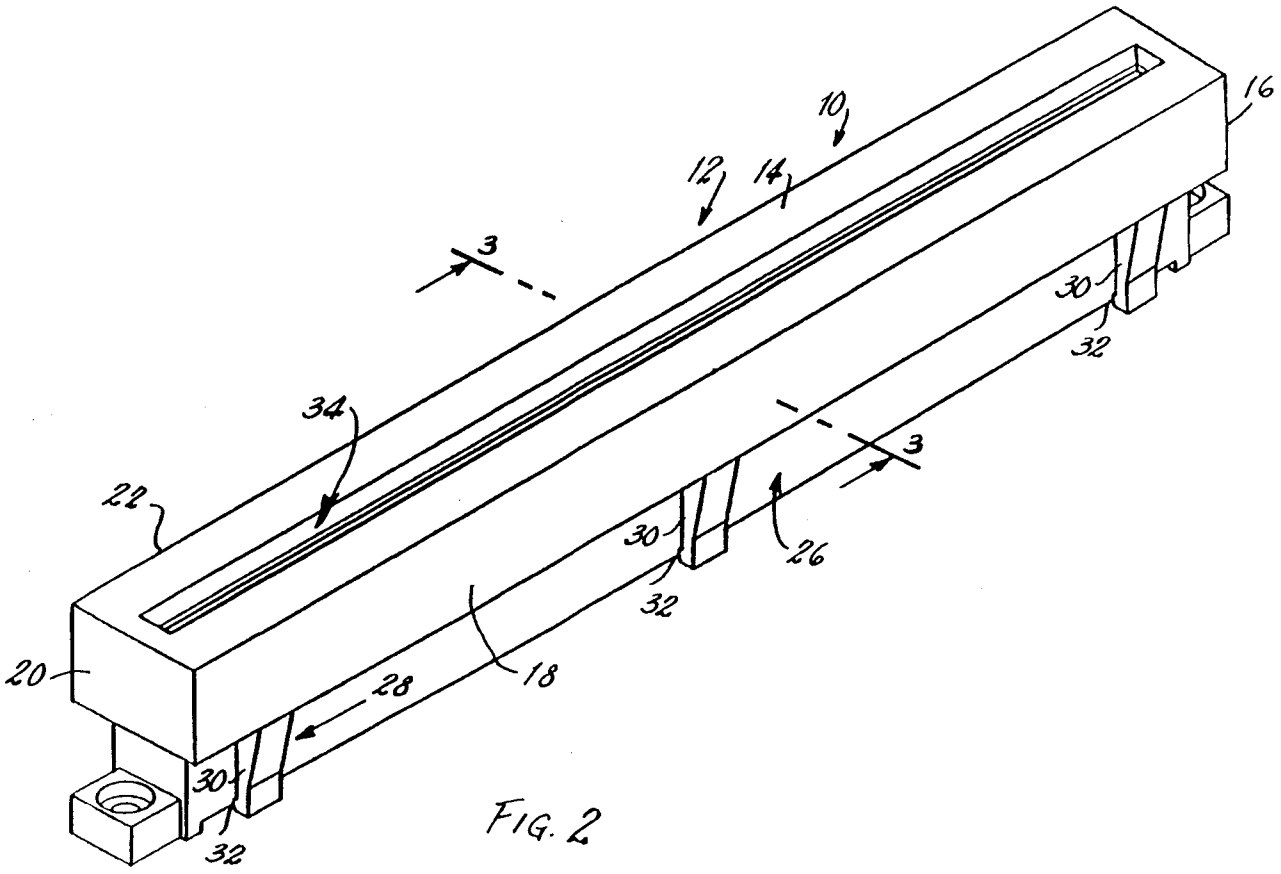
FIG. 2 is a perspective view of a dust cover assembled to a card connector.

Referring now to the drawings with greater particularity, there is shown in FIG. 1 a dust cover 10 having an elongated body 12 with a top surface 14. Four depending walls 16, 18, 20 and 22 are attached to the top surface 14 and define a hollow space 24 therebetween. The hollow space 24 is formed to receive a printed circuit board card connector 26 (FIGS. 2 and 3) which can be a ZIF connector; e.g., one of the types shown in the above-referenced patent.

Engaging means 28 are attached to at least one of the walls and are formed to cooperate with connector 26 to retain the dust cover 10 thereon. In the particular embodiment shown the engaging means 28 comprise a plurality of depending legs 30 having hooked end portions 32 for grasping the card connector 26. (See FIGS. 2 and 3).

An elongated, printed circuit board receiving slot 34 is substantially centrally-formed in the top surface 14 and a sealing gasket 36 is attached to the underside of the top surface, within hollow space 24.

The sealing gasket 36, in a specific, preferred form, includes a first flexible material 38 which can be a woven monofiliment synthetic fiber such as, e.g., nylon. This material 38 contains a slit 40 and the material 38 is preferably woven in such a way that the cut fiber ends, which terminate at the slit 40, are oriented upwarded to provide the actual contact surface for wiping a printed circuit board card 42. The exposed fiber ends provide a brush-like action to wipe dust and other contaminants off the card 42 as it is inserted into the connector 26.

Bonded to the first material 38 is a second flexible material 44 which is non-woven and rubber-like. Natural rubber, silicon rubber, neoprene or other similar materials are suitable. This second layer likewise has a slit 46 down the middle and aligned with slit 40 and insures intimate contact with the card 42 during insertion. The second material 44 also seals the opening when the card 42 is removed.

Figure 3:
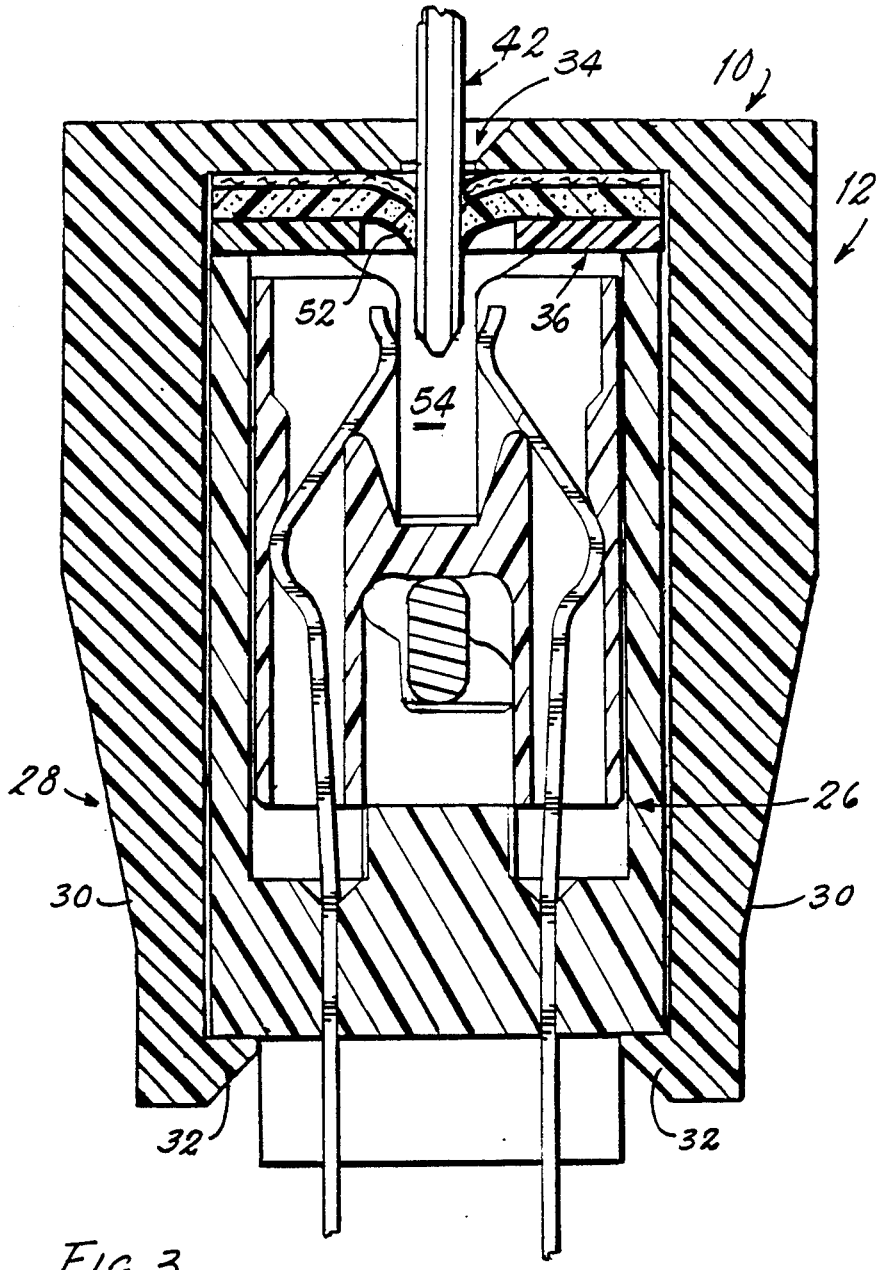
FIG. 3 is a sectional elevational view taken along the line 3—3 of FIG. 2.

The gasket 36 is completed with a third, relatively rigid material 48, such as a suitable plastic, which contains a particularly formed slot 50. The slot 50, as can be seen in FIG. 3, is formed to receive not only card 42, but also displaced material, indicated at 52, from the first and second materials, which will be pushed downward during insertion of card 42. The third material, and slot 50, thus prevent the displaced material 52 from entering the throat 54 of connector 26 and possibly causing a malfunction.

There is thus provided a dust cover that greatly alleviates the problems of the prior art, particularly as they occurred with ZIF connectors. The dust cover body 12, which is preferably made of a suitable plastic having sufficient flexibility to utilize the legs 30 so that a snap-fit can be provided, is readily made by conventional molding techniques and is relatively inexpensive, thus providing an advance in the art.

While there have been shown and described what are at present considered to be the preferred embodiments of the invention, it will be apparent to those skilled in the art that various changes and modifications can be made herein without departing from the scope of the invention as defined by the appended claims.

I claim:

1. A dust cover for a printed circuit board card connector, said dust cover comprising:

an elongated body having a top surface;

four depending walls attached to said top surface and defining a hollow space formed to receive a printed circuit board card connector;

engaging means attached to at least one of said walls and formed to cooperate with said printed circuit board card connector for retaining said dust cover in position thereon;

an elongated, printed circuit board receiving slot substantially centrally formed in said top surface; and a sealing gasket attached to the underside of said top surface within said hollow space, said sealing gasket being formed from a flexible material and having a longitudinal slit formed therein, said slit being substantially aligned with the center of said slot, said gasket comprising a laminated member of first and second dissimilar, flexible materials each having a slit.

2. The dust cover of claim 1 wherein said first material is a woven material and said second material is non-woven.

3. The dust cover of claim 2 wherein said second layer is rubber-like.

4. A dust cover for a printed circuit board card connector, said dust cover comprising:

an elongated body having a top surface;

four depending walls attached to said top surface and defining a hollow space formed to receive a printed circuit board card connector;

engaging means attached to at least one of said walls and formed to cooperate with said printed circuit board card connector for retaining said dust cover in position thereon;

an elongated, printed circuit board receiving slot substantially centrally formed in said top surface; and a sealing gasket attached to the underside of said top surface within said hollow space, said sealing gasket being formed from a flexible material and having a longitudinal slit formed therein, said slit being substantially aligned with the center of said slot, said gasket comprising a laminated member of first, second, and third dissimilar materials, said first and second materials being flexible and said third material being rigid; said first and materials including aligned, printed circuit board receiving slits formed to wipingly receive a printed circuit board, and said third material including a slot formed to receive a printed circuit board and any displaced material from said first and second materials.

5. The dust cover of claim 4 wherein said first material is woven and said second material is non-woven.

* * * * *